US005709011A

United States Patent [19]

Baechler et al.

[11] Patent Number: 5,709,011

[45] Date of Patent: Jan. 20, 1998

[54] APPARATUS FOR DETERMINING IRREGULARITIES IN THE MASS OF A SLIVER

[75] Inventors: François Baechler, Wermatswil; Jürg Zehr, Uster, both of Switzerland

[73] Assignee: Zellweger Luwa AG, Uster, Switzerland

[21] Appl. No.: 670,220

[22] Filed: Jun. 21, 1996

[30] Foreign Application Priority Data

Jun. 22, 1995 [CH] Switzerland ..... 01 828/95

[51] Int. Cl.[6] ..... D04H 11/00; D06H 3/08

[52] U.S. Cl. ..... 19/157; 19/239; 73/160

[58] Field of Search ..... 19/23, 157, 239; 73/37.7, 160

[56] References Cited

U.S. PATENT DOCUMENTS

| | | | |
|---|---|---|---|
| 4,100,791 | 7/1978 | Miller et al. | 73/160 X |
| 4,184,361 | 1/1980 | Erban | 73/160 X |
| 4,306,450 | 12/1981 | Moser | 73/160 |
| 4,318,299 | 3/1982 | Morf | 73/160 |
| 4,829,758 | 5/1989 | Gilhaus | 19/157 X |
| 4,947,947 | 8/1990 | White | 73/160 X |
| 5,501,100 | 3/1996 | Baechler et al. | 19/239 X |
| 5,537,868 | 7/1996 | Shofner et al. | 73/160 |

FOREIGN PATENT DOCUMENTS

| | | | |
|---|---|---|---|
| 1381207 | 3/1988 | U.S.S.R. | 19/23 |

*Primary Examiner*—John J. Calvert

*Attorney, Agent, or Firm*—Burns, Doane, Swecker & Mathis LLP

[57] ABSTRACT

The invention relates to a device for determining irregularities in the mass of a sliver, with a measuring chamber (21) for the sliver which has an entrance and an exit and into which a gas stream is introduced via an orifice (25, 26), a relation existing between the gas pressure in the prechamber (20) and the irregularity in mass in the sliver. In order to increase the measuring accuracy, the prechamber (20) is connected to a source of stable pressure for the gas stream via a prenozzle (47). In order to increase the measuring speed, the air volume in the prechamber is kept small. A pressure sensor is connected to the prechamber, measures the pressure fluctuations and converts these into an electrical signal.

9 Claims, 3 Drawing Sheets

APPARATUS FOR DETERMINING IRREGULARITIES IN THE MASS OF A SLIVER

FIELD OF THE INVENTION

This invention relates to apparatus for determining irregularities in the mass of textile slivers. It is concerned particularly with apparatus wherein a sliver to be measured passes through a measuring chamber into which a gas stream is introduced via an orifice or nozzle in such a manner that a relation exists between the pressure in the gas stream and irregularities in the sliver.

BACKGROUND OF THE INVENTION

DE-A-3036697 discloses such a device, in which a gas stream is injected radially into a cylindrical measuring chamber via a nozzle, so that the gas stream penetrates into the sliver and is distributed there. The gas is supplied to the measuring chamber through a conduit, and the conduit is connected to a pressure transducer. This permits the gas pressure in the conduit to be measured, and electrical signals from the transducer are recorded. The measured pressure fluctuations are interpreted as an indication of fluctuations in diameter of the sliver.

In this device, pressure fluctuations which are independent of fluctuations in diameter of the sliver are also transmitted immediately to the measuring system. Such pressure fluctuations may, for example, originate merely from particular flow conditions of limited time in the supply conduits, but are nevertheless added to the fluctuations in diameter. Or a sliver compacted in the region of the nozzle may for a short time provide greater resistance to the gas stream, so that this circumstance too can be interpreted as a fluctuation in diameter.

SUMMARY OF THE INVENTION

An object of the present invention is to provide a device which indicates the fluctuations in diameter of the sliver more accurately and more rapidly and whose operation is as free as possible from disturbing influences.

In accordance with the invention the measuring chamber is assigned or preceded by a small prechamber into which the gas passes before it enters the measuring chamber. The prechamber is delimited or separated from the measuring chamber and from the pressure or gas source, in each case by means of a nozzle or a throttle. The pressure of the gas in the prechamber, that is to say before it enters the sliver, is measured by means of a pressure sensor as an indication of the mass of the sliver.

This affords the possibility of also introducing the gas from the prechamber into the measuring chamber via a plurality of orifices and, at the same time, of measuring an averaged pressure at a single point, that is to say in the prechamber. By suitable choice of the parameters, such as the size of the prechamber, the orifices of the nozzles and of the throttle and the pressure of the gas stream at the exit from the pressure source and consequently the average pressure in the prechamber, it is possible to effect an adaptation of the device to the existing sliver masses and pressure sensors and also to record rapid pressure changes which are caused by rapidly elapsing fluctuations in mass of a sliver. The arrangement according to the invention of the prechamber and the fact that the pressure in this prechamber is recorded as a measured value thus afford the design engineer the possibility of influencing the behavior of the entire device appreciably and deliberately as a result of the design of this prechamber, namely with the effect of a very rapid response to small changes in mass of the sliver or with the effect of a shield or a filter against disturbing influences which originate from the measuring means itself.

A device according to the invention has various further advantages. For example, it makes it possible also to measure a relatively thick sliver by this method, because the arrangement of a plurality of nozzles allows the penetration of the gas stream into the middle of the sliver to be dispensed with. Furthermore, by means of this solution, the pressure sensor can be arranged very near to the prechamber or to the sliver. Furthermore, as a result of this solution, it is possible to design the measuring chamber exchangeably, so that the latter can be coordinated as closely as possible with the sliver to be measured.

BRIEF DESCRIPTION OF THE DRAWINGS

The invention is explained in more detail below by means of an example and with reference to the accompanying Figures, of which FIGS. 1 and 2 each show a section through a device according to the invention and its environment.

DETAILED DESCRIPTION OF PREFERRED EMBODIMENTS

Figure 1:
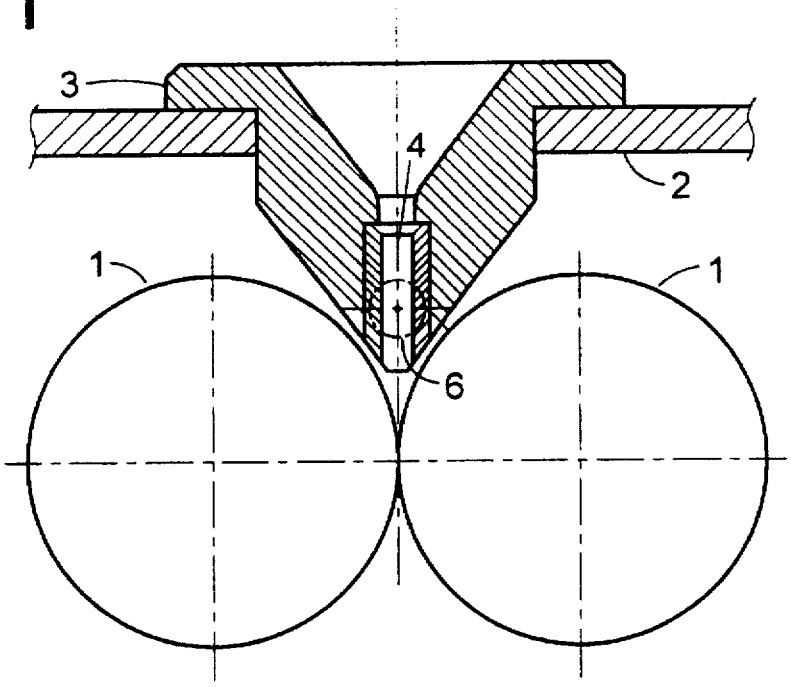

FIG. 1 shows a measuring chamber 4 in its environment, that is to say at the end of an entry funnel 3 which is fastened on a measuring-funnel plate 2. The measuring chamber 4 is arranged in the vicinity of the draw-off rollers 1 which draw the sliver, not shown here, through the measuring chamber 4.

FIG. 2 once again shows the entry funnel 3 with the measuring chamber 4 and with a sliver 5. Furthermore, a measuring unit 6, an electrical connection 7 and a gas or air conduit 8, which is connected to a source 9 for the air or gas stream, can also be seen here.

Figure 2:
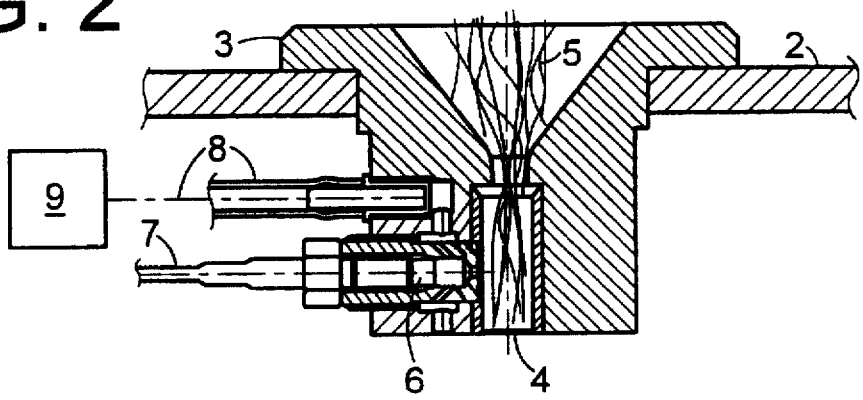
Figure 3:
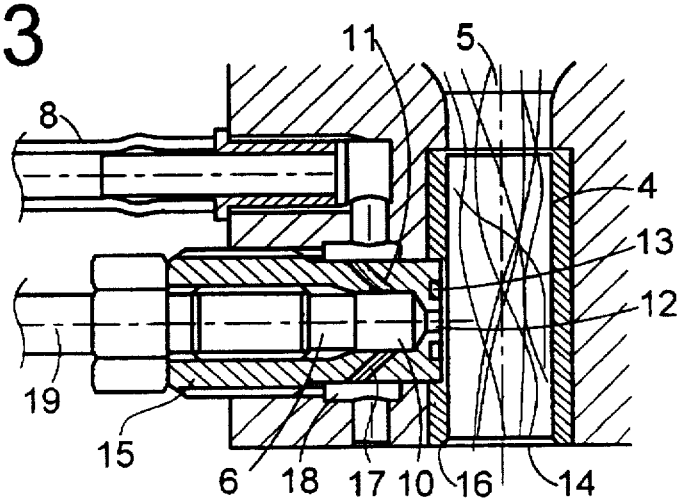
FIG. 3 is an enlarged sectional view similar to FIG. 2.

FIG. 3 shows the construction of the device according to the invention in more detail, elements already known from FIG. 2 having the same reference symbols. The measuring unit 6 can be seen here again, this being designed, for example, as an integrated pressure sensor or pressure transducer which, in a way known per se, converts a pneumatic pressure into a corresponding electrical signal. The measuring unit 6 is adjacent to a prechamber 10 which is connected to the interior 14 of the measuring chamber 4 via an orifice or nozzle 12. The measuring chamber 4 forms a cylindrical housing having an entrance and an exit for the sliver, and the prechamber 10 is located, together with the measuring unit 6, in a cylindrical housing 15 which is fixed to the measuring chamber 4 at right angles to the latter. For this purpose, the measuring chamber 4 has a recess 16. A sealing ring 13 seals off the two cylindrical housings relative to one another in the recess 16. The prechamber 10 is connected via one or more bores 11, 17 to an annular conduit 18 connected to an air conduit 8 which, here, is designed as an air hose. In this arrangement, the bore 11, 17 forms a throttle or prenozzle which delimits the pressure in the prechamber 10 from the source for the pressure or the gas and which thus brings about a predetermined pressure drop. Here, 19 denotes an axis, along which the nozzle 12, the prechamber 10 and the measuring unit 6 are lined up. In this embodiment, the nozzle 12 is incorporated into the wall of the measuring chamber 4.

Figure 4:
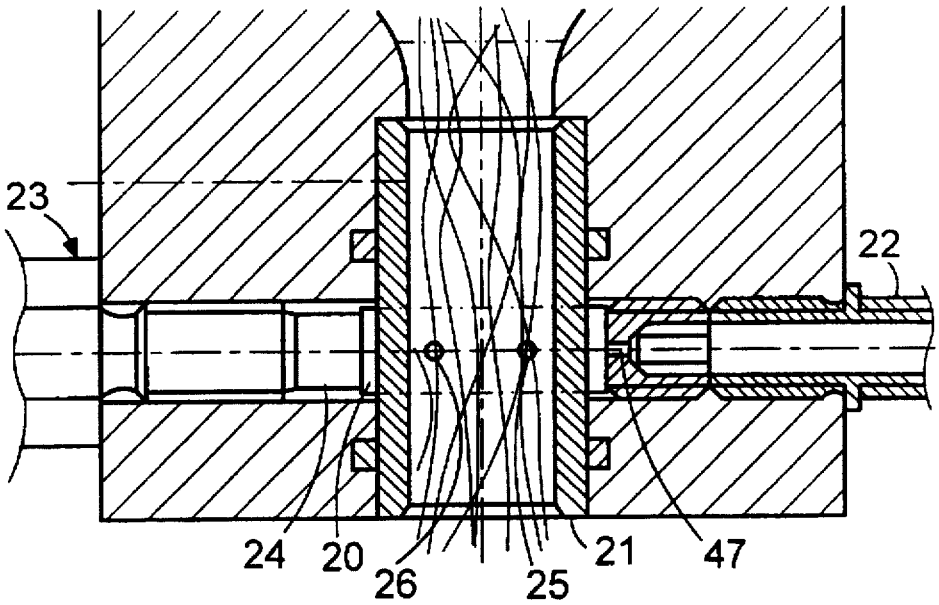
FIG. 4 is a view similar to FIG. 3 but showing another embodiment of the invention.

FIG. 4 shows an embodiment with an annular prechamber 20 which surrounds a measuring chamber 21 and which has an air conduit 22 on one side and an electrical connection 23 and a measuring unit 24 on the other side. At least two nozzles 25 and 26 open, here, out of the prechamber 20 into the measuring chamber 21. A prenozzle or throttle relative to the pressure source is designated here by 47.

Figure 5:
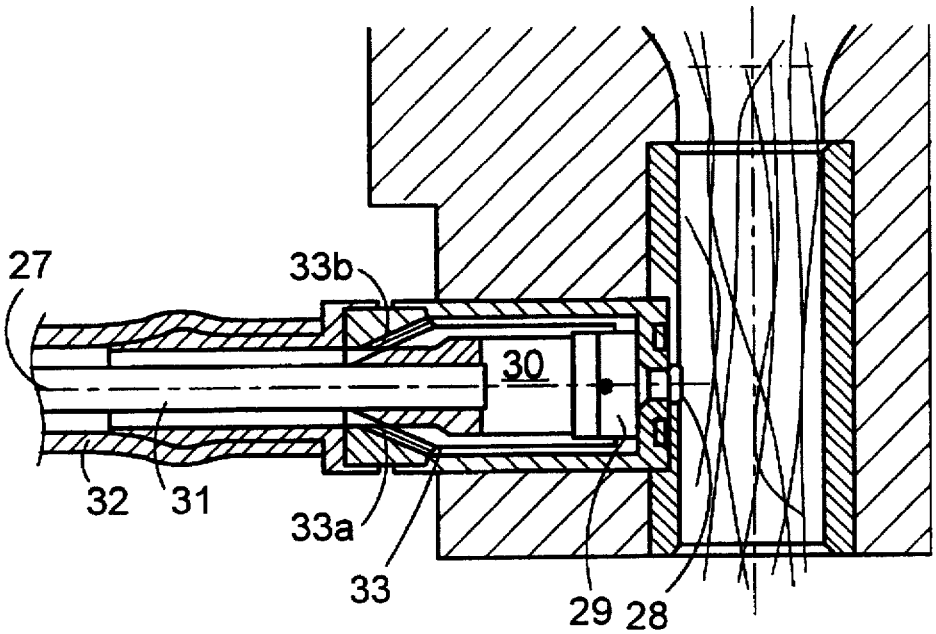
FIG. 5 also is a view similar to FIG. 3, showing still another embodiment of the invention.

FIG. 5 shows a further embodiment with a nozzle 28, prechamber 29 and measuring unit 30 arranged along an axis 27, an electrical connection 31 and a pneumatic connection 32 being arranged coaxially. In this case, the prechamber 29 is supplied with compressed air via an annular conduit 33. The annular conduit 33 acts, here, as a throttle or pre-nozzle relative to the prechamber 29. This annular conduit 33 can thus have a cylindrical shape. This annular conduit 33 is fed by two or more bores 33*a*, 33*b*, so that it may be assumed that, in the annular conduit 33, the throttle or prenozzle can consist of a plurality of bores 33*a*, 33*b* or constrictions.

Figure 6:
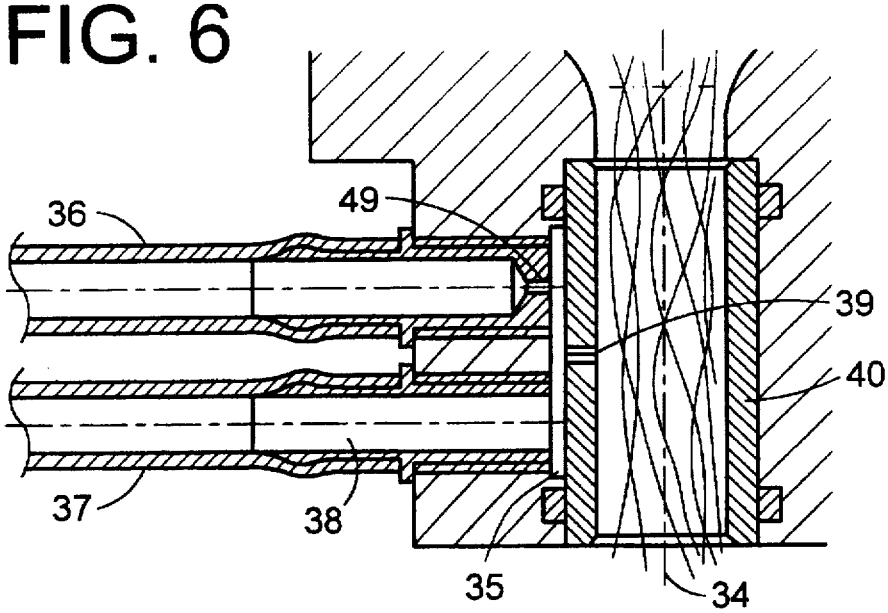
FIG. 6 also is a view similar to FIG. 3, but is shows yet another embodiment of the invention.

FIG. 6 shows an embodiment with a prechamber 35 arranged parallel to a measuring-chamber axis 34 and with an air supply 36 and a pneumatic connection 37 to the prechamber 35 for a corresponding pneumatic measuring unit. A prenozzle 49 and a nozzle 39 which opens into the measuring chamber 40 can also be seen.

Figure 7:
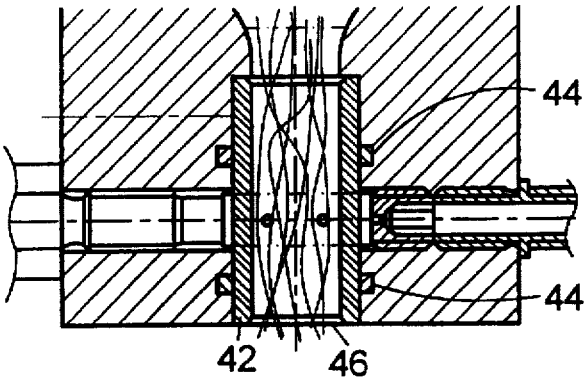
FIGS. 7 and 8 are sectional views showing the principles of the embodiment of FIG. 4 applied to a thin-walled sliver measuring chamber (FIG. 7) and to a thick-walled sliver measuring chamber (FIG. 8).
Figure 8:
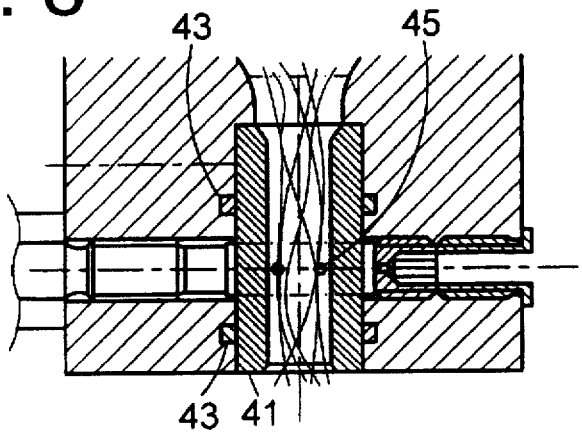

Embodiments according to FIGS. 4 and 6 are particularly suitable, in addition to the other embodiments, for providing exchangeable measuring chambers 21, 40. A comparison of further FIGS. 7 and 8 shows the embodiment according to FIG. 4 with a thick-walled measuring chamber 41 and a thin-walled measuring chamber 42. In both cases, the outside diameter is the same, so that the same construction or retention with sealing rings 43 and 44 can be used. Since it is advantageous for the accuracy of measurement if the interior 14 of the measuring chamber is predominantly filled by the sliver, the predetermined sliver thickness can be taken into account by these exchangeable measuring chambers. Exchangeable measuring chambers can also serve for varying the number of the nozzles 45, 46 and for adapting to the sliver thickness. In both embodiments, the outer circumference of the measuring chamber 21, 40 limits the prechamber 20, 35 on one side.

The device according to the invention records the pressure fluctuations in the prechamber via the measuring unit, which is designed as a pressure sensor. Upstream of the prechamber, the pressure is stabilized, since it is shielded by the throttle or prenozzle from disturbing influences which could originate from the air supply. Since, depending on size, a particular air volume can also be stored in the prechamber, the latter can also perform the function of a filter for small pressure fluctuations which are independent of the sliver or for noise caused by the sliver. Thus, the pressure sensor measures only those pressure fluctuations which are generated by the sliver and which are considered appreciable. By a suitable dimensioning of the size of the prechamber and of the inside diameter of the measuring chamber, it is possible to eliminate many possible disturbing influences before measurement and to determine or keep high the dynamics or reaction time of the device. Thus, very short fluctuations in mass of the sliver can also be measured on high-speed machines.

What is claimed is:

1. Apparatus for determining irregularities in the mass of a sliver, comprising a pair of rolls for advancing the sliver in a lengthwise direction; a funnel adjacent to said rolls for directing the sliver to said rolls; said funnel having a sliver passage extending longitudinally therethrough and having entrance and exit ends, and means in said funnel for permitting a gas stream to be introduced into said sliver passage so that the pressure in the gas stream varies in response to irregularities in a sliver passing through the sliver passage, said means comprising an orifice or nozzle intersecting said sliver passage between said entrance and exit ends of said sliver passage and a chamber connected, on the one hand, via a throttle to a source for a gas stream of stable pressure and, on the other hand, via said orifice or nozzle to the sliver passage; and a pressure measuring unit connected to said chamber.

2. Apparatus according to claim 1, wherein the gas volume of said chamber is small in relation to the volume of said sliver passage.

3. Apparatus according to claim 1, including a plurality of longitudinally spaced apart orifices leading from said chamber to said sliver passage.

4. Apparatus according to claim 1, including a plurality of annularly spaced apart orifices leading from said chamber to said sliver passage.

5. Apparatus according to claim 1, wherein said chamber has a plurality of orifices leading towards the sliver passage.

6. Apparatus according to claim 1, including means for discharging a gas stream of adjustable and stabilized pressure.

7. Apparatus according to claim 1, wherein said chamber extends parallel to the axis of the sliver passage.

8. Apparatus according to claim 1, wherein said chamber extends annularly around said sliver passage.

9. Apparatus according to claim 1, wherein said chamber is bounded on one side by the outer circumference of said sliver passage.

* * * * *